United States Patent [19]

Colin

[11] 3,945,508

[45] Mar. 23, 1976

[54] DEVICES FOR TRANSFERRING HEAVY LOADS AT SEA

[75] Inventor: Jean-Paul Colin, Saint Sebastien, France

[73] Assignee: Societe Anonyme dite: Ateliers et Chantiers de Bretagne-A C B, Nantes, France

[22] Filed: Nov. 15, 1974

[21] Appl. No.: 523,962

[30] Foreign Application Priority Data

Aug. 6, 1974 France ..... 74.27349

[52] U.S. Cl. ..... 214/13; 212/3

[51] Int. Cl.[2] ..... B65G 67/58

[58] Field of Search ..... 212/3, 3 A; 214/13, 14

[56] References Cited

UNITED STATES PATENTS

| | | | |
|---|---|---|---|
| 661,318 | 11/1900 | Nelson | 214/14 |
| 2,329,972 | 9/1943 | Zoll | 212/3 X |
| 2,916,002 | 12/1959 | Hunsucker | 214/13 X |

FOREIGN PATENTS OR APPLICATIONS

| | | | |
|---|---|---|---|
| 61,898 | 7/1913 | Austria | 212/3 |
| 846,391 | 8/1960 | United Kingdom | 214/13 |

*Primary Examiner*—Frank E. Werner

*Attorney, Agent, or Firm*—Synnestvedt & Lechner

[57] ABSTRACT

Cargo transfer device for transferring heavy loads at sea between ships or a ship and an off-shore platform. In one embodiment the device essentially comprises an inverted V-shaped cargo boom including two booms pivoted together at their top ends and to the respective ships at their bottom ends. A manoeuvering cable with its winch brings the cargo boom into position once the ships are coupled together. A lifting cable with its associated winch lifts the load at the beginning and end of the transfer operation. The transfer operation per se is insured by a traction cable with its winch and a restraining cable with its winch. This arrangement of three cables acting in three different directions prevents pendular movement of the load during transfer. The resultant force exerted by the device tends to maintain the ships at a distance from each other. In the other embodiment a crane is provided on the supply ship having its boom pivotally mounted about a horizontal pivot. A structural arm pivotally mounted on the ship being supplied is also pivotally connected to the boom. Winches and cables as in the first embodiment are also provided.

9 Claims, 2 Drawing Figures

DEVICES FOR TRANSFERRING HEAVY LOADS AT SEA

Figure 1:
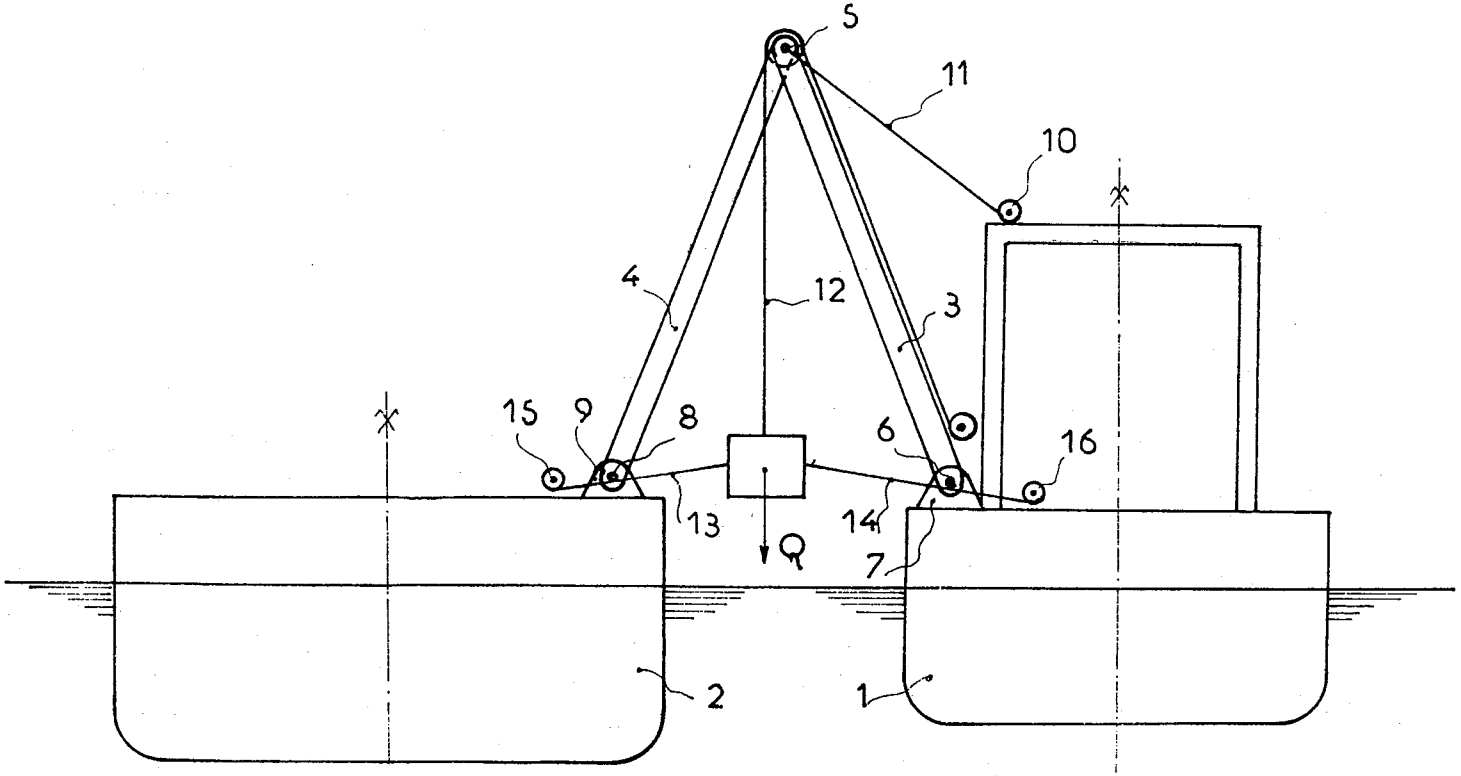

The present invention relates to devices for transferring heavy loads at sea.

It has become increasingly common to transfer diverse cargo, e.g., small equipment, food provisions, fuel in containers, sub-construction assemblies, at sea from one ship to another or from a ship to a floating platform. For carrying out such a transfer operation, cable equipment connecting the ships is generally used; however, up to now the use of such equipment has been limited to loads of less than about 5 metric tons. Further, such equipment has the drawback of not being able to eliminate the pendular movement of the load being transferred. For the transfer of heavy loads the use of more powerful lifting means, such as cranes, can only be considered in case the ships are at rest in a calm sea; however, even in case of the best possible conditions at sea, the transfer operations are still tricky owing to relative displacements of the ships caused by the swell of the sea. Further, in each of the above types of transfer, the distance between the ships must be carefully watched to avoid the possibility of collision, particularly since the above-mentioned cable transfer equipment tends to bring the ships closer together. The development of techniques used for capitalizing on the riches of the sea, namely, off-shore drilling, and the increase in capacity of certain ships and their turning speed necessitate the use of more powerful means for the transfer of heavier loads. Such loads can be, for example, large diameter pipe, motors, drives, pumps. Further, it is possible to conceive of the transfer of an entire cargo from a large ship to smaller capacity ships or barges for shuttling cargo ashore.

The device according to the invention makes it possible to transfer heavy loads between two ships at sea, whether they are at rest under calm conditions or in rough conditions, the transfer being effected smoothly without jerking, the load being maintained along its entire transfer trajectory, and the supply ship remaining at a suitable distance from the supplied ship during the entire transfer operation.

According to the invention the supply ship may have a cargo boom including first and second booms pivotally connected together at their top ends, the bottom ends of the first and second booms being respectively pivotally mounted on the decks of the two ships. The means for securing the pivotal mounting on the deck of the ship being supplied may be a quick mounting and or dismounting system. The cargo boom is arranged in a vertical plane perpendicular to longitudinal axes of the ships and is manoeuvered from aboard the supply ship by means of a winch on which is rolled a cable passing over the top pivotal connection between the booms. The load to be transferred is held at three points by means of a lifting cable, and a traction cable and a restraining cable. The two cables are driven by winches aboard the ships, winding and unwinding speeds of these latter two winches being equal. The transfer operation per se is effected once the load has been lifted sufficiently above the deck of the supply ship by means of the lifting cable. Thus, once the load has reached the desired height, it is subjected to translatory movement by means of the latter two winches.

By way of alternative embodiment, the supply ship may be equipped with a crane whose boom is connected at its free end to an arm on the ship to be supplied. Once ships are coupled, the manoeuvering cable for the boom is slackened so as not to prevent oscillating movements of the boom. The boom is provided with a trolley or crab for supporting the load, the load being also steadied during transfer by means of a traction cable and a restraining cable.

Figure 2:
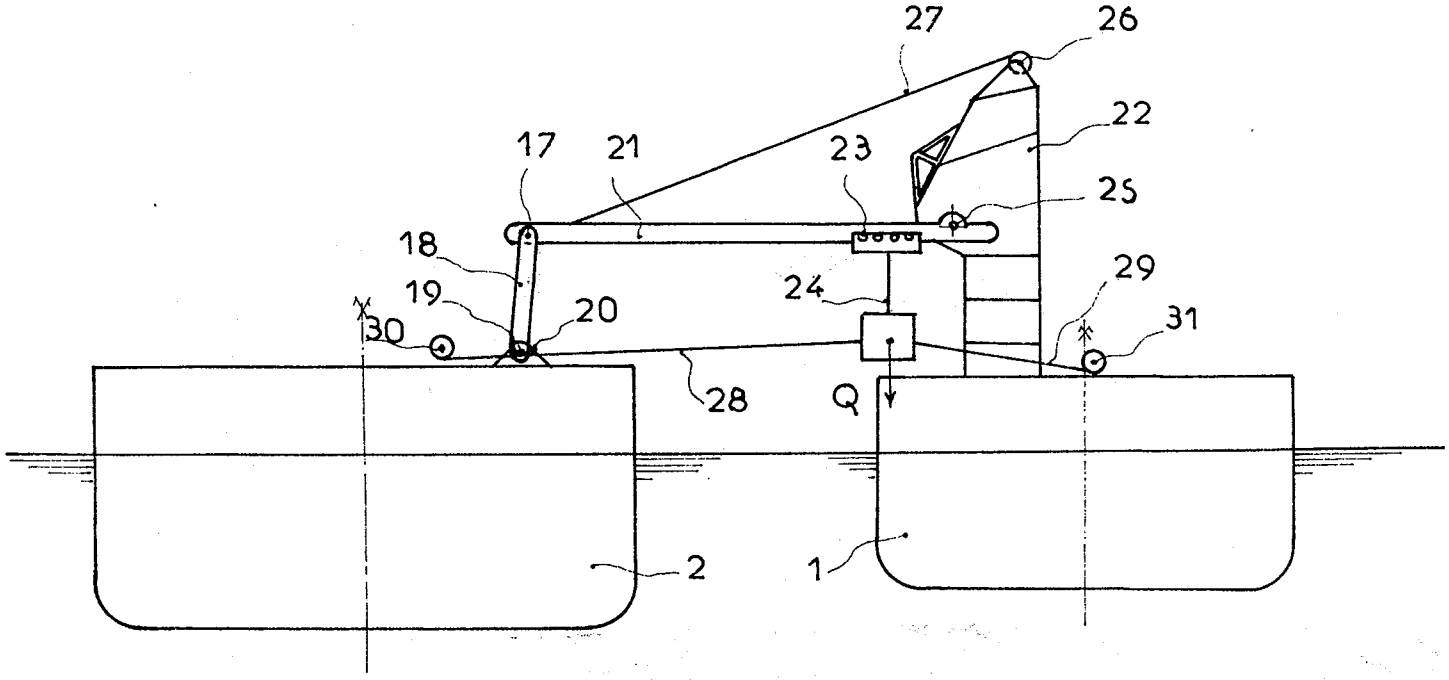

The accompanying drawings show, by way of example, two possible embodiments of the device according to the present invention, wherein:

FIG. 1 is a schematic end elevation view of a cargo transfer device having a cargo boom with two articulated booms; and FIG. 2 shows a schematic and elevation view of a cargo transfer device including a crane.

The device as shown (FIG. 1) effects the transfer of a load Q from a first supply ship 1 to a second ship or other floating vessel 2 to be supplied and comprises a cargo boom shaped as a compass and arranged in a vertical plane perpendicular to the longitudinal axes of the two ships, including two elongate structural elements or boom members 3 and 4 pivotally connected to each other at their upper ends by a pivot 5. The lower end of the boom member 3 is pivotally mounted at 6 on a yoke 7 fixed on the deck of the first ship. The lower end of the boom member 4 is pivotally mounted at 8 on a pivotal mounting device 9 fixed to the deck of the second ship, the mounting device 9 may be of the quick mounting and/or dismounting type such as systems using one or more electromagnets for example. The manoeuvering of the cargo boom necessary for effecting the coupling of the two ships is controlled from the first ship by means of a winch 10 around which is wound a cable 11 secured to the top end of the cargo boom.

In order to avoid pendular movement of the load Q, the load Q is held at three points by means of a lifting cable 12, a traction cable 13 and a retaining cable 14 driven by the winches 15 and 16, respectively, fixed to the decks of the first and second ships.

The winding and unwinding speeds of the winches 15 and 16 are equal so that the load Q is constantly maintained during the transfer operation, the lifting cable 12 being tensioned by the load. The transfer operation per se can get under way once the load is lifted several dozen centimeters. At the end of the transfer operation per se, the load Q is set down on the deck of the second ship by means of the lifting cable 12. During the entire transfer operation the manoeuvering cable 11 is sufficiently tensioned so as not to adversely affect the variations in the angle formed by the boom members and the oscillations thereof. The resultant force on the device constantly tends to move the ships apart during the transfer of the load, thereby eliminating any possibility of collision. The maximum desired distance between the ships is maintained by moorings thrown from one ship to the other.

It is possible to provide only the supply ship with the necessary winches for the lifting and lowering, and transfer operations.

FIG. 2 shows a second possible embodiment of the cargo transfer device. In this embodiment the ships are also coupled by means of two elongate structural elements pivotally connected to each other by a pivot 17, that is, an arm member 18 pivotally mounted at one end at 19 on a pivotal mounting device 20 of the quick mounting and/or dismounting type fixed to the deck of the second ship being supplied and a boom member 21 pivotally mounted on the frame of the crane 22 which is fixed to the deck of the first supply ship. The boom member 21 of the crane has a track for the displacement of a crab or trolley 23 from which a lifting cable 24 depends. The crab or trolley 23 is driven by a motor (not shown) mounted in the crane 22, for displacement along the track; the winch (not shown) for the lifting cable is also mounted abroad the crane 22. During the linking up operation, the boom member 21 mounted for oscillating movement about a horizontal pivot 25 is manoeuvered by a winch 26 controlling the manoeuvering cable 27. In order to avoid pendular movement of the load Q lifted several decimeters above the deck of the supply ship at the beginning of the transfer operation, the load Q is maintained by means of a traction cable 28 and a restraining cable 29 driven by winches 30 and 31, respectively, fixed to the decks of the first and second ships. The winding and unwinding speeds of the winches are equal so that the load Q is never free. During the entire transfer operation the manoeuvering cable 27 is sufficiently slackened so as not to inhibit oscillations of the boom member about the pivot 25.

It goes without saying, and follows from the above, that the invention is in no way limited to the mode of construction of its different specifically identified parts but on the contrary encompasses all possible variations within the scope of the appended claims.

The present invention is applicable to all heavy load cargo transfers between two ships or a ship and a platform at sea, even if the sea is rough, regardless if the ships are at rest or in motion.

What we claim is:

1. A device for transferring heavy loads from a supply ship to another floating vessel to be supplied, comprising a first elongate structural element pivotally mounted on the supply ship, a second elongate structural element pivotally mounted on the floating vessel, pivot means pivotally interconnecting said elongate structural elements remote from their respective pivotal mountings, a lifting cable associated with a first winch for raising and lowering the load at the beginning and end of a transfer operation, a traction cable and a restraining cable associated with a second and third winches, respectively, and acting in opposed directions on the load during the transfer operation, whereby the cables cooperate to prevent oscillating and pendular movement of the load during the transfer operation and at the same time the resultant force exerted by the device tends to keep the supply ship at a distance from the floating vessel.

2. A device according to claim 1, wherein said first and second elongate structural elements form a cargo boom which in operation is disposed in a vertical plane perpendicular to the longitudinal axes of the ship and the floating vessel, the pivotal mountings of said structural elements allowing variations of the included angle therebetween and therefore oscillations of the cargo boom.

3. A device according to claim 2, further comprising a manoeuvering cable for manoeuvering the cargo boom into position when the ship is coupled to the floating vessel, and a fourth winch associated with the manoeuvering cable mounted aboard the supply ship, and wherein the manoeuvering cable remains slack during the transfer operation.

4. A device according to claim 1, wherein the lifting, traction and restraining cables act on the load at three distinct points, an idle pulley being freely mounted at the pivot means pivotally interconnecting the structural elements, the second and third winches being mounted on the supply ship and the floating vessel respectively, and winding and unwinding speeds of the second and third winches being equal so that the tension of the traction and restraining cables are maintained throughout the transfer operation.

5. A device according to claim 1, wherein the lifting cable is generally disposed vertically, and the traction and restraining cables are generally disposed horizontally.

6. A device according to claim 1, wherein the second elongate structural element is pivotally mounted in a quick mounting and dismounting assembly.

7. A device according to claim 1, wherein the first, second and third winches are all mounted on the supply ship.

8. A device according to claim 1, wherein the first elongate structural element is a boom of a crane mounted on the supply ship and the second elongate structural element is a connecting arm, the boom being pivotally mounted about a horizontal axis and having along its length a track for displacement of a crab, the lifting cable and first winch being mounted on the crab.

9. A device according to claim 1, and further comprising a second device substantially identical to the first-mentioned device and mounted in parallel therewith.

* * * * *